US007586509B2

(12) United States Patent
Koizumi et al.

(10) Patent No.: US 7,586,509 B2
(45) Date of Patent: Sep. 8, 2009

(54) THERMAL TRANSFER PRINTER RIBBON CASSETTE APPARATUS AND RIBBON CASSETTE MOUNTING METHOD

(75) Inventors: Hideaki Koizumi, Tokyo (JP); Osamu Fukuzawa, Tokyo (JP)

(73) Assignee: Kabushiki Kaisha Sato (JP)

( * ) Notice: Subject to any disclaimer, the term of this patent is extended or adjusted under 35 U.S.C. 154(b) by 379 days.

(21) Appl. No.: 11/681,028

(22) Filed: Mar. 1, 2007

(65) Prior Publication Data

US 2008/0213023 A1 Sep. 4, 2008

(51) Int. Cl.
*B41J 32/00* (2006.01)

(52) U.S. Cl. ..... 347/214

(58) Field of Classification Search ..... 347/214, 347/222; 400/691, 692
See application file for complete search history.

(56) References Cited

U.S. PATENT DOCUMENTS 4,944,619 A 7/1990 Suzuki et al. ..... 400/224.2
5,868,508 A 2/1999 Suzuki ..... 400/692
6,285,387 B1 9/2001 Ueno et al. ..... 347/222

FOREIGN PATENT DOCUMENTS

JP 2006-82297 3/2006
JP 2006281556 * 10/2006

OTHER PUBLICATIONS

Computer-generated translation of JP-2006082297 cited in the IDS filed Mar. 1, 2007.*
Computer-generated translation of JP_2006281556 published on Oct. 2006.*

* cited by examiner

*Primary Examiner*—Huan H Tran
(74) *Attorney, Agent, or Firm*—Ostrolenk Faber LLp

(57) ABSTRACT

A thermal transfer ribbon printer ribbon cassette apparatus and a ribbon cassette mounting method by which a ribbon cassette for a thermal transfer ribbon of large roller size can be easily and reliably set in a thermal transfer printer. Focussing on the use of a main guide shaft as an initial guide, guidability along a printer main body stay and, finally, engageability of a final positioning engagement pin and a final position engagement hole, a cassette main body is formed to be attachable to a printer main body by providing a cassette main body stay in which a main guide hole to which a main guide shaft is formed detachably, a final positioning engagement pin formed in a printer main body stay, and a final positioning engagement hole formed in a handle-side base plate.

12 Claims, 13 Drawing Sheets

THERMAL TRANSFER PRINTER RIBBON CASSETTE APPARATUS AND RIBBON CASSETTE MOUNTING METHOD

BACKGROUND OF THE INVENTION

1. Field of the Invention

The present invention relates to a thermal transfer printer ribbon cassette apparatus and a ribbon cassette mounting method, and more particularly to a thermal transfer printer ribbon cassette apparatus and a ribbon cassette mounting method by which the mounting operation of a ribbon cassette main body to a printer main body is simple and reliable.

2. Description of the Prior Art

Thermal transfer ribbons loaded in conventional thermal transfer printers are thin. As a result, snaking and wrinkling thereof readily occurs as they are supplied to the transport path and during winding from the transport path. Accordingly, stable transport of wide thermal transfer ribbons in particular is afforded by a system as described, for example, in Japanese Unexamined Patent Application No. 2006-82297. Rather than the thermal transfer ribbon being set on ribbon shafts (supply spindle and winding spindle) provided in the printer main body, the thermal transfer ribbon is loaded in advance in a ribbon cassette which is then loaded in the printer main body.

However, there are problems inherent in the loading of a ribbon cassette of this type in a printer, in that it causes a further demand for simplifying the attachment operation to shorten the ribbon replacement time and for simplification of the operation for loading the thermal transfer ribbon into the ribbon cassette.

There are problems inherent in the use of a thermal transfer printer and so on in assembly with various types of peripheral apparatus (for example label affixing apparatus), in factories or manufacturing sites in particular, in that, as a consequence of the need for the thermal transfer ribbon to be loaded in large rolls of large diameter (for example, 1000 m winding or the like) and due to the increased weight thereof, better operability and convenience of the mounting operation of the ribbon cassette is desirable.

A further problem arises if the thermal transfer printer is installed in a narrow space from the viewpoint of the difficulty of the attachment operation of the ribbon cassette.

An additional problem arises if the thermal transfer printer itself is three-dimensionally installed in a range of positions from the viewpoint of the need to further simplify the implementation of the attachment operation of the ribbon cassette.

More specifically, there is a problem from the viewpoint of the need for a simple and reliable mounting operation based on a simple guide mechanism when, as an initial stage mounting operation, the ribbon cassette is moved toward the thermal transfer printer.

The mounting of the ribbon cassette in the thermal transfer printer requires that the thermal head and the platen roller of a printing unit of the printer be established in a mutually separated state and, following the mounting of the ribbon cassette, requires that the thermal head and the platen roller be again closed in a predetermined pressed state and, in addition, requires that the ribbon cassette eventually be fixed in the printer. From the viewpoint of convenience of the operation, the separate implementation of the approach/separate operation of the thermal head and the platen roller and the final mounting and fixing operation of the ribbon cassette on the thermal transfer printer should be avoided. In this respect as well, there is a need for improved convenience of the operations.

Furthermore, when the thermal transfer ribbon is used in the form of a large roll of increased weight, this raises the possibility that thermal transfer ribbon mounted in the ribbon cassette will fall from each of the ribbon supply spindle and the ribbon winding spindle through the cassette main body side while they are handled. Accordingly, there is an inherent problem from the viewpoint of a need for simplicity and reliability of the structures for mounting and fixing (inserting) and operations for mounting and fixing (inserting) the ribbon supply spindle and the ribbon winding spindle in the cassette main body.

Because the ribbon supply spindle and ribbon winding spindle are mounted in the ribbon cassette side, there is a need for the ribbon supply spindle and ribbon winding spindle rotation drive mechanisms to be linked when the ribbon cassette is mounted and fixed on the printer side. A structure for engaging and disengaging gear mechanisms between the printer and the ribbon cassette is normally used for this purpose. When the ribbon cassette is being mounted on the thermal transfer printer, there is a problem from the viewpoint of a need for the mounting operation to be based on a smooth engagement of these gear mechanisms with each other to enable reliable implementation.

There is a further inherent problem from the possibility of increased impact noise being generated during the final mounting of the ribbon cassette on the thermal transfer printer, which accompanies increases in size and weight of the thermal transfer ribbon and ribbon cassette and the need to eliminate this impact noise.

In addition, there is a further inherent problem from increased vibration generated in the thermal transfer printer main body associated with the transport and printing of the thermal transfer ribbon and print sheet and accompanying increases in size and weight of the thermal transfer ribbon and ribbon cassette and the unwanted unavoidable effects thereof on the printing of the printing sheet and transport thereof in the thermal transfer printer.

SUMMARY OF THE INVENTION

With the foregoing problems in mind, it is an object of the present invention to provide a thermal transfer printer ribbon cassette apparatus and method of ribbon cassette mounting in which the operations for loading and replacement of the thermal transfer ribbon can be implemented easily.

A further object of the present invention is to provide a thermal transfer printer ribbon cassette apparatus and method of ribbon cassette mounting in which the loading processing and the replacement processing are possible in a short time.

Another object of the present invention is to provide a thermal transfer printer ribbon cassette apparatus and method of ribbon cassette mounting in which both the operation for loading of the ribbon in the ribbon cassette itself and the operation for loading the cassette itself in the printer main body can be efficiently implemented.

Another object of the present invention is to provide a thermal transfer printer ribbon cassette apparatus and method of ribbon cassette mounting in which a ribbon cassette comprising a large roll thermal transfer ribbon in particular is able to be simply and reliably mounted in the thermal transfer printer side.

Another object of the present invention is to provide a thermal transfer printer ribbon cassette apparatus and method of ribbon cassette mounting in which, if the thermal transfer printer is installed in a narrow space, or if the thermal transfer printer itself is three-dimensionally installed in a range of positions, the insert-attach operation of the ribbon cassette is able to be executed even more simply.

Another object of the present invention is to provide a thermal transfer printer ribbon cassette apparatus and method of ribbon cassette mounting in which a simple and reliable mounting operation based on a simple guide mechanism is possible when, as an initial stage mounting operation, the ribbon cassette is moved toward the thermal transfer printer.

Another object of the present invention is to provide a thermal transfer printer ribbon cassette apparatus and method of ribbon cassette mounting in which the approach/separate operation of the thermal head and platen roller in the thermal transfer printer and final mounting and fixing operation of the ribbon cassette on the thermal transfer printer is able to be implemented in a simple operation.

Another object of the present invention is to provide a thermal transfer printer ribbon cassette apparatus and method of ribbon cassette mounting in which the possibility of the thermal transfer ribbon falling from each of the ribbon supply spindle and ribbon winding spindle through the cassette main body side is avoided, and the simplicity and reliability of the structures for mounting and fixing (inserting-removing) the ribbon supply spindle and the ribbon winding spindle on the cassette main body and the operations for the mounting and fixing (inserting-removing) thereof can be ensured.

Another object of the present invention is to provide a thermal transfer printer ribbon cassette apparatus and method of ribbon cassette mounting in which during mounting of the ribbon cassette in the thermal transfer printer, the gear mechanisms can be smoothly engaged with each other.

Another object of the present invention is to provide a thermal transfer printer ribbon cassette apparatus and method of ribbon cassette mounting in which there is a possibility of reducing the impact noise generated during the final mounting of the ribbon cassette on the thermal transfer printer.

Another object of the present invention is to provide a thermal transfer printer ribbon cassette apparatus and method of ribbon cassette mounting in which unwanted effects due to vibration generated in the thermal transfer printer as a whole are prevented from extending to the printing of the printing sheet and transport thereof in the thermal transfer printer.

The present invention focuses on a three-stage guide structure and engagement structure such that as a cassette main body is moved toward a printer main body for mounting therein, a main guide shaft that protrudes in a comparatively long length from the printer main body side in the cassette main body direction is used as an initial guide providing guidability along a level and comparatively wide printer main body stay. Finally, there is engageability of a final positioning engagement pin of high positioning precision formed in the printer main body stay and a final position engagement hole formed in a handle-side base plate.

A first invention comprises a thermal transfer printer ribbon cassette apparatus releasably attached to a thermal transfer printer which comprises a printer main body wherein a thermal head and a platen roller are mounted and where a printing sheet and a thermal transfer ribbon are held between the thermal head and the platen roller and are transported, and which performs printing on the printing sheet. It further comprises a cassette main body formed by a printer-side base plate that extends along a direction of transport of the printing sheet and the thermal transfer ribbon and that opposes a cassette attachment face of the printer main body. A handle-side base plate opposes the printer-side base plate. The handle-side base plate comprises handles for an attachment/detachment operation. A support shaft fixes the handle-side base plate and the printer-side base plate with a gap not less than the width of the thermal transfer ribbon and the printing sheet. The cassette main body comprises a ribbon supply spindle for supplying the thermal transfer ribbon to a transport path for the thermal transfer ribbon and a ribbon winding spindle for winding the thermal transfer ribbon transported to this transport path. The spindles are able to be releasably disposed between the handle-side base plate and the printer-side base plate. A cassette main body stay is positioned between the handle-side base plate and the printing-side base plate. There is a main guide hole into which a main guide shaft protruding from the printer main body side in the cassette main body direction is removably fit. A guide cut-away part is guidable along the printer main body stay formed from the printer main body side toward the printer-side base plate formed in the printer-side base plate. A final positioning engagement pin is formed in the printer main body stay of the printer main body. A final positioning engagement hole is formed in the handle-side base plate. The cassette main body is releasably attached to in the printer main body by engagement/disengagement of the main guide shaft of the printer main body with and from the main guide hole of the cassette main body stay and by engagement/disengagement of the final positioning engagement pin of the printer main body stay with and from the final positioning engagement hole of the handle-side base plate.

A second invention comprises a thermal transfer printer ribbon cassette mounting method for setting the thermal transfer printer ribbon to a thermal transfer printer. That printer comprises a printer main body where a thermal head and a platen roller are mounted and where a printing sheet and a thermal transfer ribbon are held between the thermal head and the platen roller and are transported. This prints on the printing sheet. The method comprises forming a cassette main body by providing a printer-side base plate that extends along a direction of transport of the printing sheet and the thermal transfer ribbon and that opposes a cassette attachment face of the printer main body, forming a handle-side base plate that opposes the printer-side base plate and that comprises handles for an attachment/detachment operation, and providing a support shaft for fixing the handle-side base plate and the printer-side base plate with a gap not less than the width of the thermal transfer ribbon and the printing sheet. The cassette main body is formed to comprise a ribbon supply spindle for supplying the thermal transfer ribbon to a transport path for the thermal transfer ribbon and a ribbon winding spindle for winding the thermal transfer ribbon transported to this transport path that are able to be releasably disposed between the handle-side base plate and the printer-side base plate. A cassette main body stay is positioned between the handle-side base plate and the printing-side base plate in which a main guide hole into which a main guide shaft protruding from the printer main body side in the cassette main body direction is removably fit. A guide cut-away part guidable along the printer main body stay is formed from the printer main body side toward the printer-side base plate in the printer-side base plate. A final positioning engagement pin is formed in the printer main body stay of the printer main body. A final positioning engagement hole is formed in the handle-side base plate. The cassette main body is operated handles to engage the main guide shaft hole of the cassette main body stay with the main guide shaft of the printer main body. The guide cut-away part of the printer-side base plate is moved along the printer main body stay as the cassette main body is moved nearer the cassette attachment face of the printer main body. The final positioning engagement hole of the handle-side base plate is engaged with the final positioning engagement pin of the printer main body stay so that the cassette main body can be attached to or detached from the printer main body.

A cover may be mounted in the printer main body, in which an opening is formed in the cassette main body side through which the cassette main body is guidable to the printer main body side.

The printer-side base plate comprises an auxiliary engagement pin provided toward the printer main body side. An auxiliary engagement hole is formed in the cassette attachment face of the printer main body in which the assist engagement pin is engageable.

A head opening/closing lever for a contact/separation operation of the thermal head and the platen roller and a cassette attachment lever for fixing the cassette main body to the printer main body are connected to be integrally operable.

A supply spindle guide groove and a winding spindle guide groove along which the ribbon supply spindle and the ribbon winding spindle respectively are guidable in set directions are formed in the inner-side wall face of the handle-side base plate and the printer-side base plate, respectively. A spindle receiving member able to fix the ribbon supply spindle and the ribbon winding spindle to their respective set positions is provided in the rearmost part of the supply spindle guide groove and the winding spindle guide groove.

Driven gears are formed in the printer main body side end parts of each of the ribbon supply spindle and the ribbon winding spindle. The driven gears are engageable with driver gears that face the cassette attachment face of the printer main body. The gear end parts of each of the driven gears and the driver gears are formed in a tapered shape.

A magnet is in at least one of the cassette attachment face of the printer main body and a printer main body opposing face opposing the printer main body of the printer-side base plate. The cassette main body is attachable to the printer main body.

An elastic member is mounted in an opening edge part of the main guide hole of the cassette main body, toward the cassette attachment face of the printer main body.

An end part of the cassette main body stay on the opposing side to the printer main body of the main guide hole can be opened.

An end part of the cassette main body stay on the opposing side to the printer main body of the main guide hole can be closed.

A lever fixing pin is provided in the vicinity of the platen roller in a base frame of the printer main body. A head opening/closing lever is engaged with or disengaged from the lever fixing pin so that the thermal head is able to be held in a pressed state at a predetermined pressure on the platen roller. The handle-side base plate can to be fixed to the base frame by an auxiliary opening/closing lever in the handle-side base plate in a different position from that of the head opening/closing lever and an auxiliary lever fixing pin in the base frame and by engagement of the assist lever fixing pin and the auxiliary opening-closing lever.

In the thermal transfer printer ribbon cassette apparatus and method of ribbon cassette mounting based on the present invention, because of the provision of a three-stage guide structure and engagement structure that is broadly based on the use of a main guide shaft protruding in a comparatively long length from the printer main body side in the cassette main body direction being as an initial guide and then guidability along a level and comparatively wide printer main body stay and, finally, engageability of a final positioning engagement pin of high positioning precision formed in the printer main body stay and a final position engagement hole formed in a handle-side base plate, even if the width and length of the thermal transfer ribbon is increased with a resultant increase in the size and weight of the ribbon cassette itself, a stable mounting operation in which the cassette main body itself is easily and reliably guided while being pushed in the printer main body direction can be executed by a simple operation based on the holding of handles on the handle-side base plate.

According to the first invention in particular, because a main guide shaft, printer main body stay and final positioning engagement hole are provided in the printer main body side and, corresponding thereto, a main guide hole, guide cut-away part and final positioning engagement hole are formed in the cassette main body side, the cassette main body can be easily and reliably mounted in the printer main body by a sequential engagement and guiding thereof.

According to the second invention in particular, as the cassette main body is moved nearer to engage with the main guide hole and guide cut-away part and as it uses the main guide shaft and guide cut-away part provided in the printer main body side as a guide, the final positioning engagement pin of the printer main body can be engaged with good positioning precision with the final positioning engagement hole of the cassette main body, and the cassette main body can be easily and reliably and stably mounted to the printer main body.

DESCRIPTION OF THE PREFERRED EMBODIMENTS

The present invention concerns a thermal transfer printer ribbon cassette apparatus and method of ribbon cassette mounting including a main guide shaft, a printer main body stay and a final positioning engagement hole provided in a printer main body side all being guided to and sequentially engaged with a main guide hole, a guide cut-away part and a final positioning engagement hole respectively formed in a cassette main body side. As a result, the cassette main body can be stably mounted easily and reliably in the printer main body.

A thermal transfer printer ribbon cassette apparatus and method of ribbon cassette mounting according to a first embodiment of the present invention are described with reference to FIG. 1 to FIG. 12.

Figure 2:
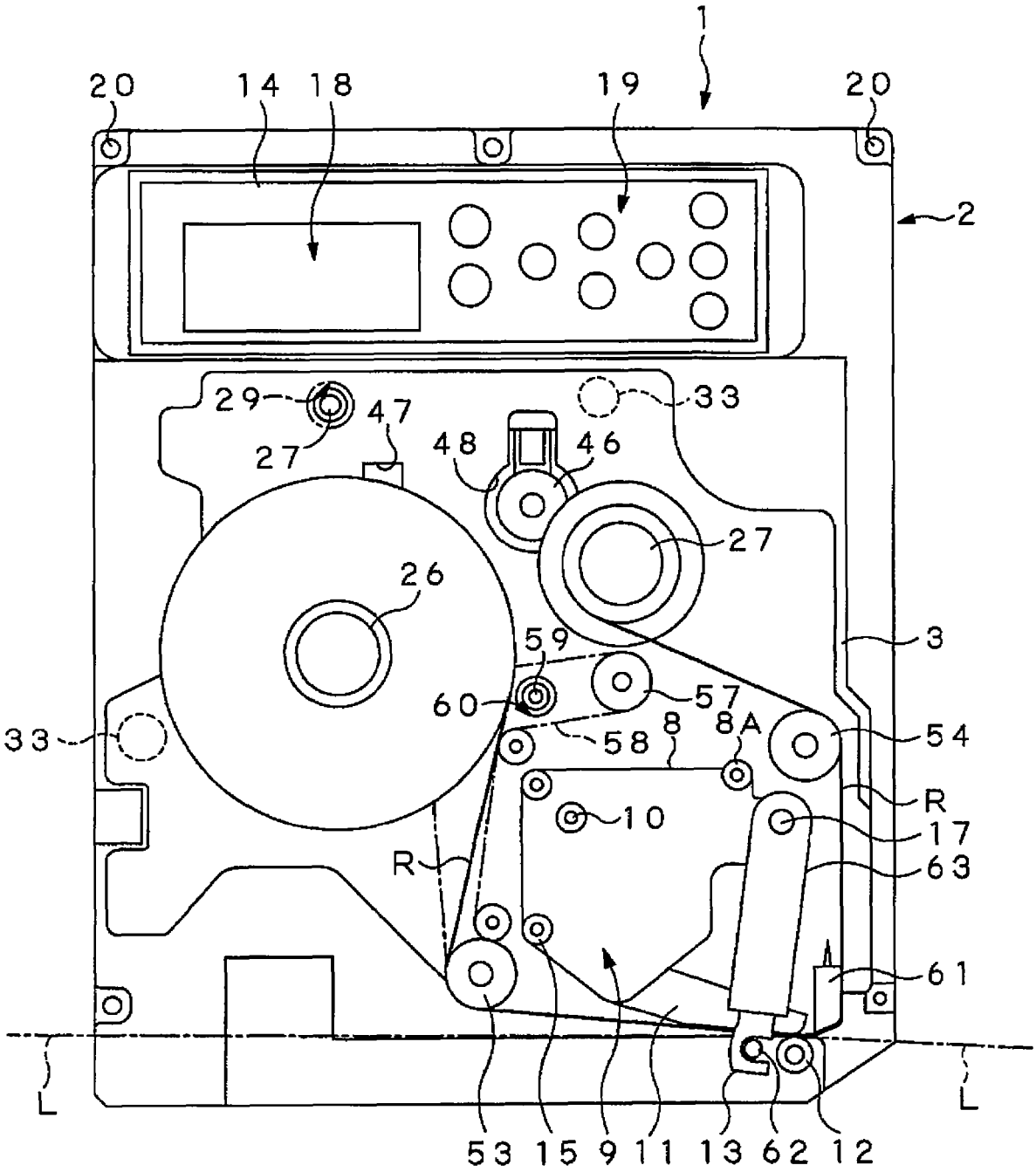
FIG. 2 is a front view as seen in the direction from the ribbon cassette apparatus to the printer main body of the same.

To illustrate the relative positional relationships from the side of the respective members, FIG. 2 has been drawn without consideration of the front-to-rear relationships of each member in the printer main body 2 direction.

The thermal transfer printer 1 comprises a printer main body 2, ribbon cassette apparatus 3, and cover 4 of a rectangular (U-shaped) cross-section mounted on the printer main body 2.

Figure 1:
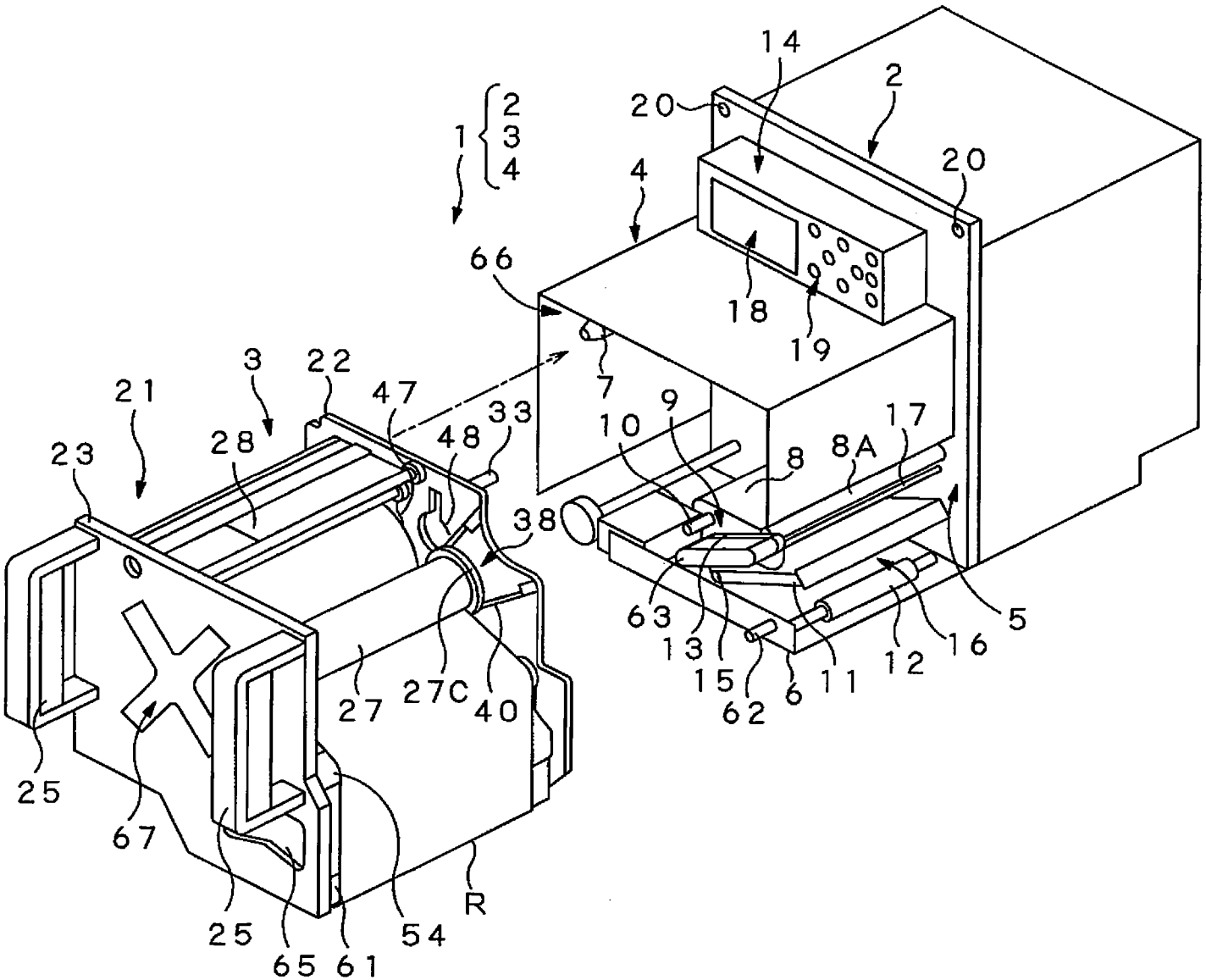
FIG. 1 is a perspective view of a printer main body and a ribbon cassette apparatus of a thermal transfer printer according to a first embodiment of the present invention.
Figure 5:
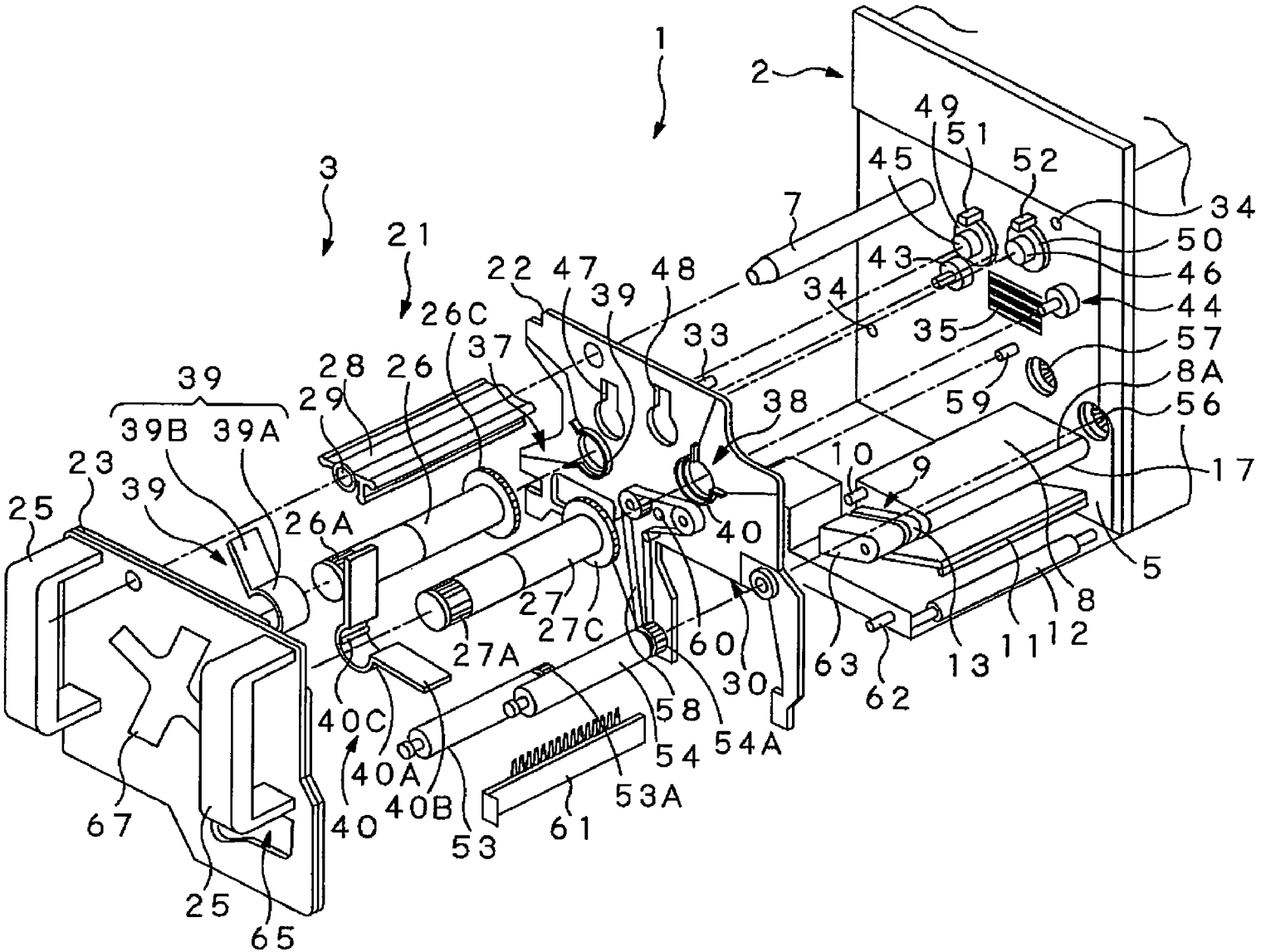
FIG. 5 is an exploded perspective view of the ribbon cassette apparatus as seen in the direction of the printer main body.
Figure 6:
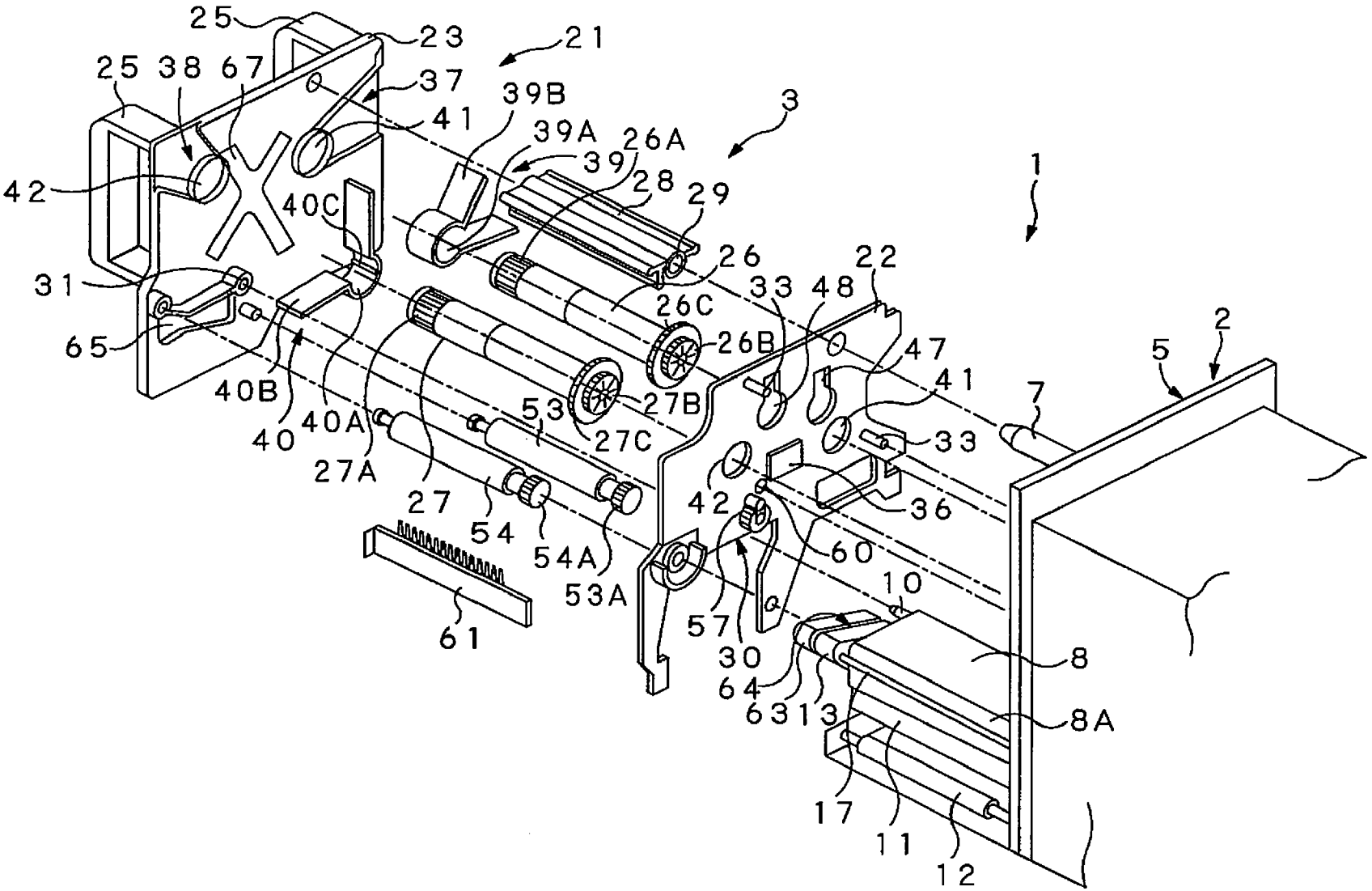
FIG. 6 is an exploded perspective view of the ribbon cassette apparatus as seen from the direction of the printer main body.

As shown in FIG. 1 and FIG. 5 in particular, the printer main body 2 comprises a cassette attachment face 5 formed from a side frame parallel to the direction of transport of a printing sheet L and thermal transfer ribbon R (FIG. 2), a base frame 6, main guide shaft 7, printer main body stay 8, final positioning face 9, final positioning engagement pin 10, thermal head 11, platen roller 12, head opening/shutting lever 13 and operating panel 14. FIG. 5 and FIG. 6 have been drawn omitting the cover 4 and the operating panel 14.

The base frame 6 orthogonally intersects with the cassette attachment face 5 and is fixed by a cantilever method so as to be positioned in FIG. 1 in the lower part of the ribbon cassette apparatus 3.

The main guide shaft 7 protrudes in a comparatively long length from the cassette attachment face 5 in the direction of the ribbon cassette apparatus 3 across the base frame 6.

The printer main body stay 8 has an upper surface that is wide and is a comparatively broad surface area. It is fixed by a cantilever method to orthogonally intersect with the cassette insertion face 5.

The final positioning face 9 is positioned in the side face of the printer main body stay 8. It is configured from another side frame that orthogonally intersects with the printer main body stay 8, and it opposes the ribbon cassette apparatus 3.

The final positioning engagement pin 10 protrudes from the final positioning face 9 in the direction of the ribbon cassette apparatus 3 to enable maintaining the high precision of the final mounted position of the ribbon cassette apparatus.

The thermal head 11 is turnable in the opening/shutting direction (separating direction and pressing direction with respect to the platen roller 12) about a head opening/shutting spindle 15 provided to extend between the cassette attachment face 5 and the final positioning face 9.

In the opened thermal head 11 state, labels, tags or other ribbon-like printing sheet L are loaded between the thermal head 11 and platen roller 12. A ribbon-like thermal transfer ribbon R is similarly able to be loaded between the thermal head 11 and the platen roller 12 employing a ribbon cassette apparatus 3.

In the closed state of the thermal head 11, the printing sheet L and the thermal transfer ribbon R are held between the thermal head and the platen roller 12 and are transported along a transport path 16 enabling printing on the printing sheet L.

The thermal head 11 is approach/separated opened and shut with respect to the platen roller 12 by the turnable operation of the head opening/shutting lever 13 in the forward and reverse directions around a lever shaft 17 which extends from the cassette attachment face 5 and the final positioning face 9. The thermal head 11 is able to be pressed onto the platen roller 12 at a predetermined printing pressure.

As described later, the head opening/shutting lever 13 is concentric with a section of the lever shaft 17 and is integrally operable with the cassette attachment lever 63 because of a small space (base plate interval 64, see FIG. 11) provided in the axial direction therebetween.

The operating panel 14 comprises a display 18 and operating keys 19 and is used for performing printing and providing various controls on the printer main body 2.

Mounting holes 20 are formed in each of the four corners of the printer main body 2 side in the cassette attachment face 5 and in other positions as needed for facilitating an assembly in which the printer main body 2 (ribbon cassette apparatus 3) is able to be connected with predetermined peripheral apparatus (for example label affixing apparatus not shown) at arbitrary positions.

Figure 3:
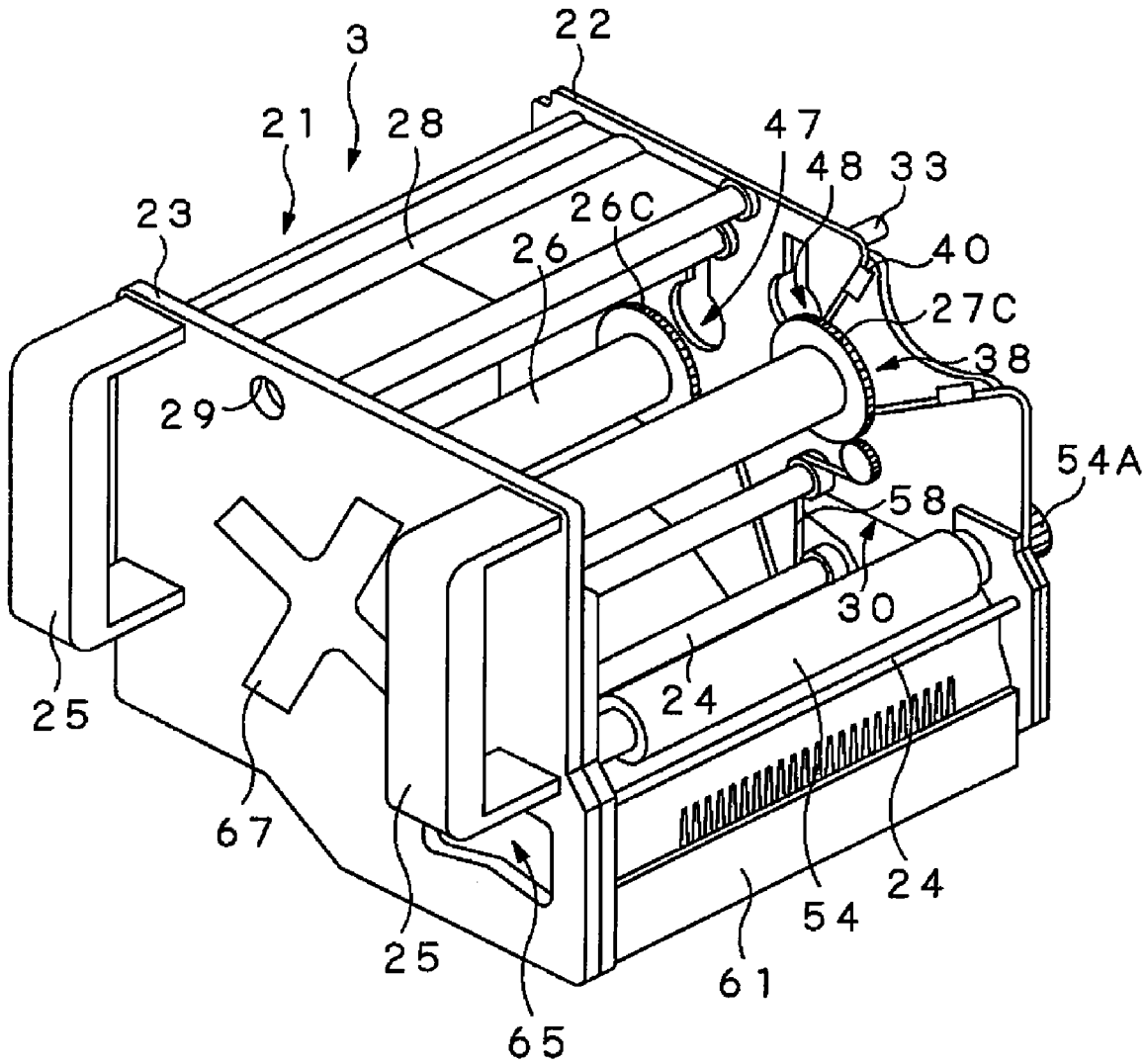
FIG. 3 is a perspective view of the ribbon cassette apparatus as seen in the direction of the printer main body.
Figure 4:
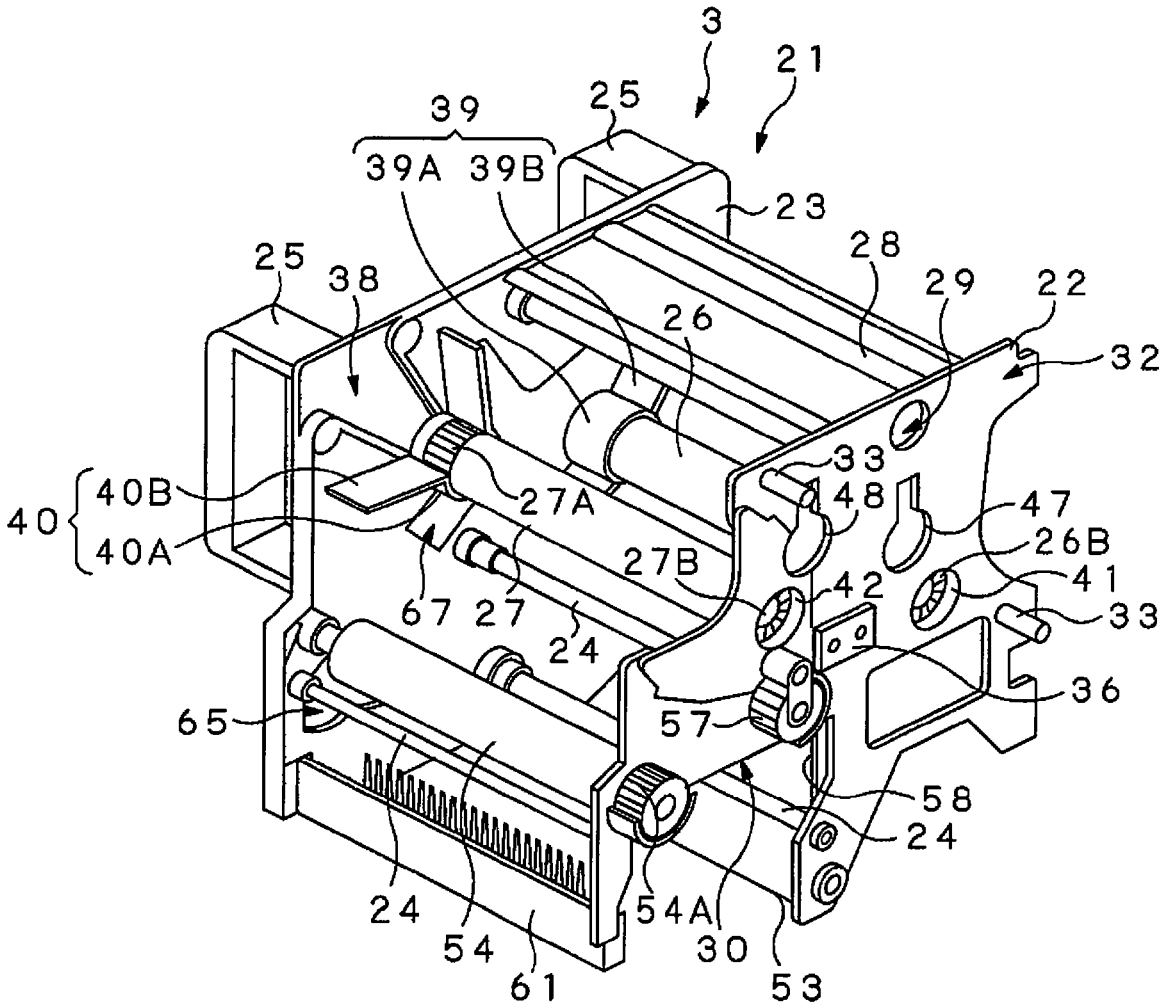
FIG. 4 is a perspective view of the ribbon cassette apparatus as seen from the printer main body of the same.

As shown in FIG. 5 and FIG. 6, the ribbon cassette apparatus 3 comprises a cassette main body 21, which comprises a printer-side base plate 22, a handle-side base plate 23, and a plurality of support shafts 24, for example, as seen in FIG. 3 and FIG. 4.

The printer-side base plate 22 extends along the direction of transport of the printing sheet L and thermal transfer ribbon R and also opposes the cassette attachment face 5 of the printer main body 2.

The handle-side base plate 23 comprises a pair of handles 25 that oppose the printer-side base plate 22 by way of the support shafts 24 and that are used for the attachment operation of the cassette main body 21 in the printer main body 2.

The support shafts 24 fix the printer-side base plate 22 and handle side base plate 23 at an interval of no less than the width of the printing sheet L and the thermal transfer ribbon R.

The cassette main body 21 facilitates attachment of a ribbon supply spindle 26 for supplying the thermal transfer ribbon R to the transport path 16 of the thermal transfer ribbon R and a winding supply spindle 27 for winding the thermal transfer ribbon R transported along the transport path 16 between the printer-side base plate 22 and handle-side base plate 23.

The cassette main body 21 further comprises a cassette main body stay 28 having an upper surface of a comparatively broad surface area.

The cassette main body stay 28 is positioned between the printer-side base plate 22 and the handle-side base plate 23. A main guide hole 29 is formed in the stay and the main guide shaft 7 that protrudes from the printer main body 2 side in the cassette main body 21 direction is insertable into the hole 29.

Insertion of the main guide shaft 7 in the main guide hole 29 is facilitated by forming of the tip-end of the shaft in a tapered shape.

Moreover, an end of the main guide hole 29 of the cassette main body stay 28, on the opposing side to the printer main body 2, is open. This facilitates smooth insertion of the main guide shaft 7 in the main guide hole 29.

A guide cut-away part 30 is formed in the printer-side base plate 22, it is guidable along the upper surface and the arc-shaped end part 8A of the printer main body stay 8 which extends from the printer main body 2 toward the printer-side base plate 22 and the circular arc-shaped end part of the part 30.

A final positioning engagement hole 31 (FIG. 6) is formed in the inner wall face side of the handle-side base plate 23. It opposes the final positioning engagement pin 10 formed in the printer main body stay 8 of the printer main body 2 at the final positioning face 9.

A printer main body opposing face 32 that opposes the printer main body 2 of the printer-side base plate 22 comprises a plurality (two in the example of the diagram) of assist engagement pins 33 (FIGS. 4 and 6) provided toward the printer main body 2 side, and assist engagement holes 34 (FIG. 5) engageable with the assist engagement pins 33 are formed in the cassette attachment face 5 of the printer main body 2.

A magnet 35 (FIG. 5) is provided in the cassette attachment face 5 of the printer main body 2 and an iron piece 36 (FIG. 6) is provided on the printer main body opposing face 32 of the printer-side base plate 22 to facilitate the attachment of the cassette main body 21 (printer main body opposing face 32) to the printer main body 2 (cassette attachment face 5).

Figure 7:
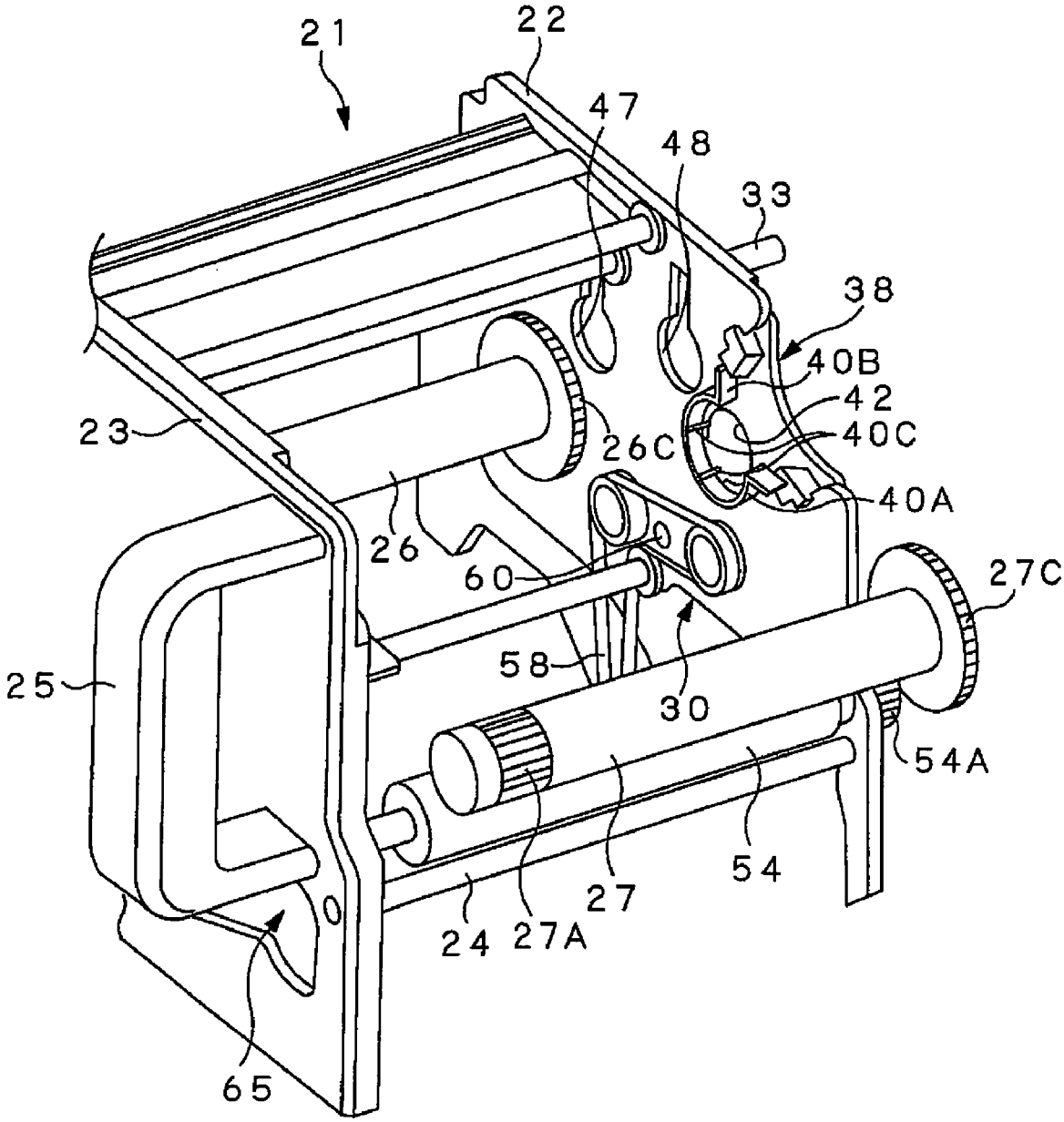
FIG. 7 is a main part perspective view of a cassette main body as seen in the direction of the printer main body in a state in which a thermal transfer ribbon R has not been loaded in the cassette main body.
Figure 8:
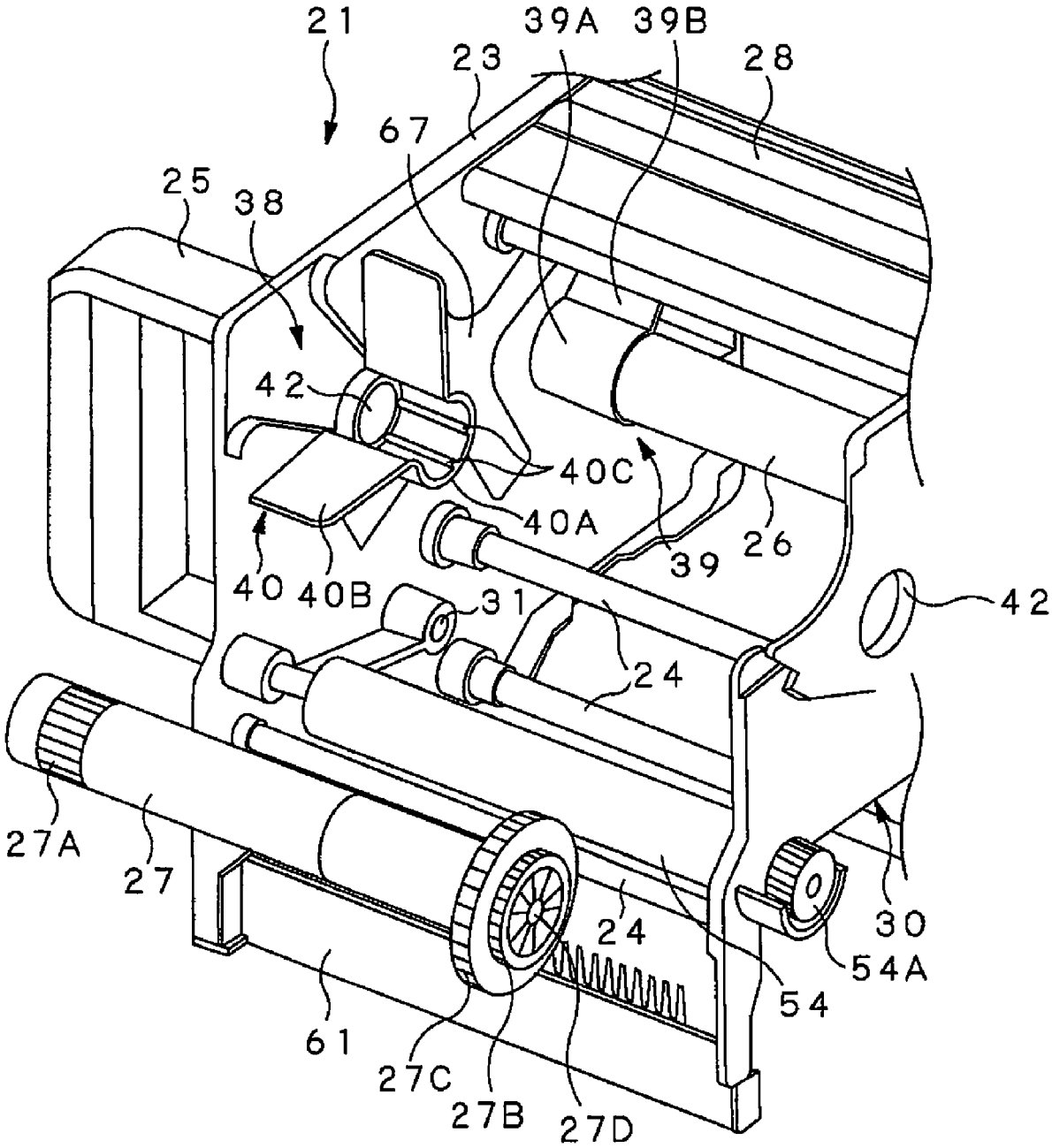
FIG. 8 is a main part perspective view of the cassette main body as seen from the printer main body.

FIG. 7 is a main part perspective view of the cassette main body 21 as seen from the direction of the printer main body 2 in a state in which the thermal transfer ribbon R has not been loaded into the cassette main body 21, and FIG. 8 is a main part perspective view of the cassette main body 21 as seen from the printer main body 2 of the same.

A supply spindle guide groove 37 and winding spindle guide groove 38 (FIG. 5, FIG. 6) able to guide the ribbon supply spindle 26 and winding supply spindle 27 respectively in the set directions thereof are formed in the inner side wall face of the printer-side base plate 22 and handle-side base plate 23 respectively. Spindle receiving members (left-right pair of supply spindle receiver members 39 and winding spindle receiver members 40 in the respective axial directions thereof) able to fix the ribbon supply spindle 26 and the winding supply spindle 27 to their respective set positions are also provided.

More specifically, referring to FIG. 5 as well as FIG. 6, the supply spindle receiver member 39 comprises a circular arc-shaped spindle part 39A that is inserted and fixed in a supply spindle receiving hole 41 formed in the rearmost part of the supply spindle guide groove 37, and a pair of guide flank parts 39B that extend outward along the supply spindle guide groove 37 from the two end parts of the circular arc-shaped spindle part 39A.

Similarly, the winding spindle receiver member 40 comprises a circular arc-shaped spindle part 40A that is inserted and fixed in a winding spindle receiving hole 42 formed in the rearmost part of the winding spindle guide groove 38, and a pair of guide flank parts 40B that extend outward along the supply spindle guide groove 38 from the two end parts of the circular arc-shaped spindle part 40A.

However, the supply spindle receiver member 39 and winding spindle receiver member 40 fixed in the inner wall face of the printer-side base plate 22 are narrower in width than the supply spindle receiver member 39 and winding spindle receiver member 40 fixed in the inner wall face of the handle-side base plate 23.

Furthermore, the guide flank part 39B of the supply spindle receiver member 39 and the guide flank part 40B of the winding spindle receiver member 40 fixed in the inner wall face of the printer-side base plate 22 are smaller than the guide flank part 39B of the supply spindle receiver member 39 and the guide flank part 40B of the winding spindle receiver member 40 fixed in the inner wall face of the handle-side base plate 23.

A plurality of axial direction protrusions 39C and protrusions 40C are formed protrudingly in the inner circumferential surface side of the circular arc-shaped spindle part 39A and circular arc-shaped spindle part 40A and, as a result of being engageable with a supply spindle circumferential groove 26A and winding spindle circumferential groove 27A formed in each of the end parts of the handle-side base plate 23 side of the ribbon supply spindle 26 and ribbon winding spindle 27, the ribbon supply spindle 26 and winding supply spindle 27 are fixable to a section of the supply spindle receiver member 39 and winding spindle receiver member 40 and are prevented from easily falling out.

On the other hand, as shown in FIG. 6 in particular, follower gears (supply spindle follower gear 26B, winding spindle follower gear 27B) are formed in the end parts of the printer main body 2 (cassette attachment face 5) side of the ribbon supply spindle 26 and the winding supply spindle 27.

As shown in FIG. 5 in particular, the supply spindle follower gear 26B and winding spindle follower gear 27B, are engageable by way of the supply spindle receiving hole 41 and the winding spindle receiving hole 42 respectively with follower gears (supply spindle driver gear 43, supply spindle driver gear 44) that face the cassette attachment face 5 of the printer main body 2.

Furthermore, similarly to the supply spindle follower gear 26B and winding spindle follower gear 27B, detection gears (supply spindle detection gear 26C, winding spindle detection gear 27C) of larger diameter than the supply spindle follower gear 26B and winding spindle follower gear 27B are formed in the end parts of the ribbon supply spindle 26 and the winding supply spindle 27 to be engageable by way of open windows (supply spindle open window 47, winding spindle open window 48) with sensor-side gears (supply spindle sensor-side gear 45, winding spindle sensor-side gear 46).

Figure 9:
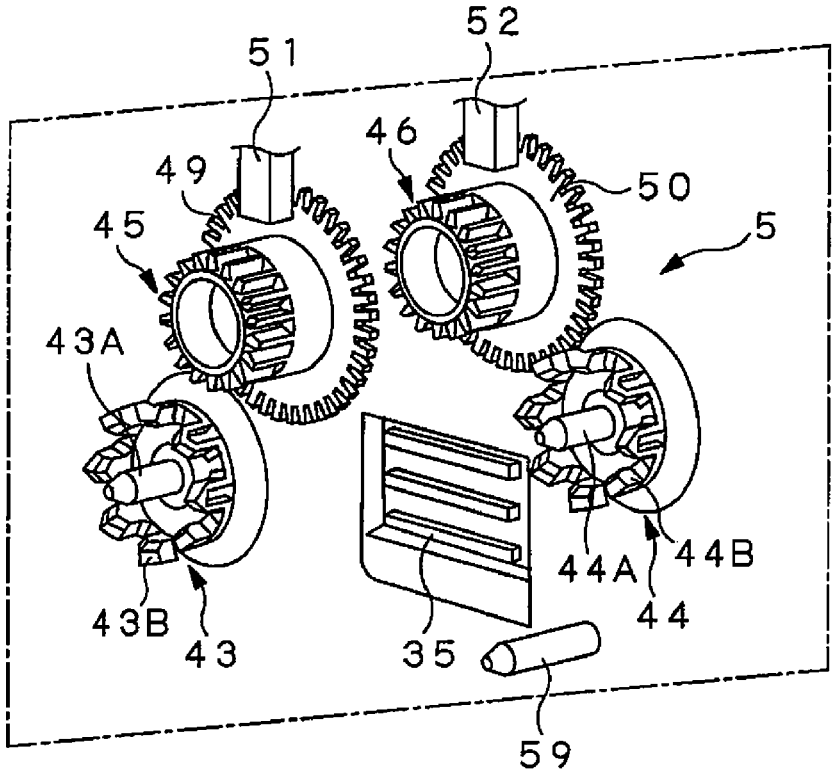
FIG. 9 is a main part expanded perspective view of supply spindle driver gear, a winding spindle driver gear and, a supply spindle sensor-side gear and a winding spindle sensor-side gear, all components that face onto a cassette attachment face of the printer main body.
Figure 10:
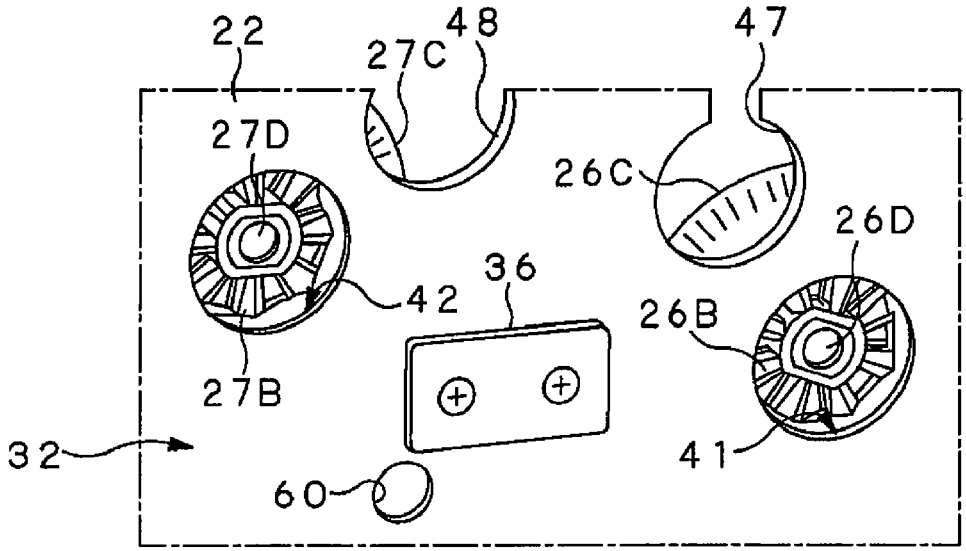
FIG. 10 is a main part expanded perspective view of a supply spindle follower gear and winding spindle follower gear components that face onto a printer main body opposing face of the cassette main body (printer-side base plate)

FIG. 9 is a main part expanded perspective view of the supply spindle driver gear 43 and winding spindle driver gear 44, as well as the supply spindle sensor-side gear 45 and winding spindle sensor-side gear 46 components facing the cassette attachment face 5 of printer main body 2, and FIG. 10 is a main part expanded perspective view of the supply spindle follower gear 26B and winding spindle follower gear 27B components that face the printer main body opposing face 32 of the cassette main body 21 (printer-side base plate 22).

As shown in FIG. 9 in particular, the supply spindle driver gear 43 comprises an engagement center pin 43A that protrudes from the center part thereof, and an engagement gear 43B that is formed slightly lower in the circumference of the engagement center pin 43A.

The winding spindle driver gear 44 comprises an engagement center pin 44A that protrudes from the center part thereof, and an engagement gear 44B that is formed slightly lower in the circumference of the engagement center pin 44A.

As shown in FIG. 10 in particular, an engagement center hole 26D and engagement center hole 27D are formed in the center part of the supply spindle follower gear 26B and winding spindle follower gear 27B in the ribbon supply spindle 26 and winding supply spindle 27 to facilitate engagement with the engagement center pin 43A and the engagement center pin 44A respectively. Moreover, by the adoption of a tapered shape end part of each of the engagement center pin 43A and engagement center pin 44A, the engagement thereof with the engagement center hole 26D and engagement center hole 27D respectively is simple and reliable.

Furthermore, by the adoption of a tapered shape gear end part of each of the follower gears (supply spindle follower gear 26B, winding spindle follower gear 27B) and the engagement gear 43B and engagement gear 44B of the driver gears (supply spindle driver gear 43, winding spindle driver gear 44), the engagement operations therebetween can be implemented easily and reliably irrespective of the turning position (position in the circumferential direction) of the ribbon supply spindle 26 and the winding supply spindle 27.

In addition, by the adoption of a tapered shape gear end part of each of also the supply spindle detection gear 26C and winding spindle detection gear 27C and the supply spindle sensor-side gear 45 and winding spindle sensor-side gear 46 of the ribbon supply spindle 26 and winding supply spindle 27 respectively, the engagement operations therebetween can be implemented easily and reliably.

Detection discs (supply spindle detection disc 49, winding spindle detection disc 50) comprising slits in the circumference are concentrically mounted with the supply spindle sensor-side gear 45 and the winding spindle sensor-side gear 46 respectively, and detection of the rotation state of the ribbon supply spindle 26 and winding supply spindle 27 being facilitated by rotation sensors (supply spindle rotation sensor 51, winding spindle rotation sensor 52).

The ribbon supply spindle 26 and winding supply spindle 27 are divided between the printer-side base plate 22 and handle-side base plate 23 (details omitted), and these divided components are independently rotatable structures.

Accordingly, whenever the supply spindle circumferential groove 26A is engaged with the circular arc-shaped spindle part 39A and the winding spindle circumferential groove 27A is engaged with the circular arc-shaped spindle part 40A (see FIG. 6) in the handle-side base plate 23 side and, furthermore, with reference to FIG. 5 and FIG. 6, whenever the supply spindle follower gear 26B is engaged with the supply spindle driver gear 43 and the winding spindle follower gear 27B is engaged with the winding spindle driver gear 44 in the printer-side base plate 22 side and, in addition, whenever the supply spindle sensor-side gear 45 is engaged with the supply spindle detection gear 26C and the winding spindle detection gear 27C is engaged with the winding spindle sensor-side gear 46, each of the ribbon supply spindle 26 and winding supply spindle 27 are rotatable between the printer-side base plate 22 and the handle-side base plate 23 to facilitate the supply and winding of the thermal transfer ribbon R.

Moreover, as shown in FIG. 2, FIG. 5 and FIG. 6 and other diagrams, transport assist rollers (upstream-side assist roller 53, and downstream-side assist roller 54) to assist in transporting of the thermal transfer ribbon R are provided between the printer-side base plate 22 and handle-side base plate 23 in the upstream side and downstream side of the platen roller 12 along the transport path 16 of the thermal transfer ribbon R.

The upstream-side assist roller 53 and downstream-side assist roller 54 are rotatably supported between the printer-side base plate 22 and handle-side base plate 23, and follower gears (upstream side follower gear 53A, downstream-side follower gear 54A) are each formed in the printer main body 2 side of the upstream-side assist roller 53.

As shown in FIG. 5 in particular, the upstream-side assist roller 53 and downstream-side assist roller 54 are rotatably-drivable by means of the follower gears (upstream-side driver gear 55, downstream-side driver gear 56) that face the cassette attachment face 5 of the printer main body 2.

The upstream-side follower gear 53A of the upstream-side assist roller 53 is engageable with the upstream-side driver gear 55 by way of an opposing face gear 57 provided in the printer main body opposing face 32 of the printer-side base plate 22 (FIG. 6) and a timing belt 58 (FIG. 5) provided in the side opposing the handle-side base plate 23 on the opposing side to the printer main body opposing face 32 of the printer-side base plate 22.

The downstream-side follower gear 54A of the downstream-side assist roller 54 is directly engageable with the downstream-side driver gear 56.

As shown in FIG. 2, FIG. 5 and FIG. 9 in particular, a guide pin 59 of which the tip-end part is formed in a tapered shape is protrudingly provided from the cassette attachment face 5 of the printer main body 2 in the region of the magnet 35, and a through-hole 60 (FIG. 6, FIG. 10) with which the guide pin 59 is engageable is formed in the printer-side base plate 22 whereupon, when the cassette main body 21 is moved toward and abuts the cassette attachment face 5, a reliable adsorption is established between the magnet 35 and iron piece 36 and a reliable engagement of the upstream-side assist roller 53 and downstream-side assist roller 54 with the upstream-side driver gear 55 and downstream-side driver gear 56 is established.

In addition, a brush member 61 which performs an anti-static action on the thermal transfer ribbon R is provided in the downstream side of the platen roller 12 to extend across the transport path 16 of the thermal transfer ribbon R.

Figure 11:
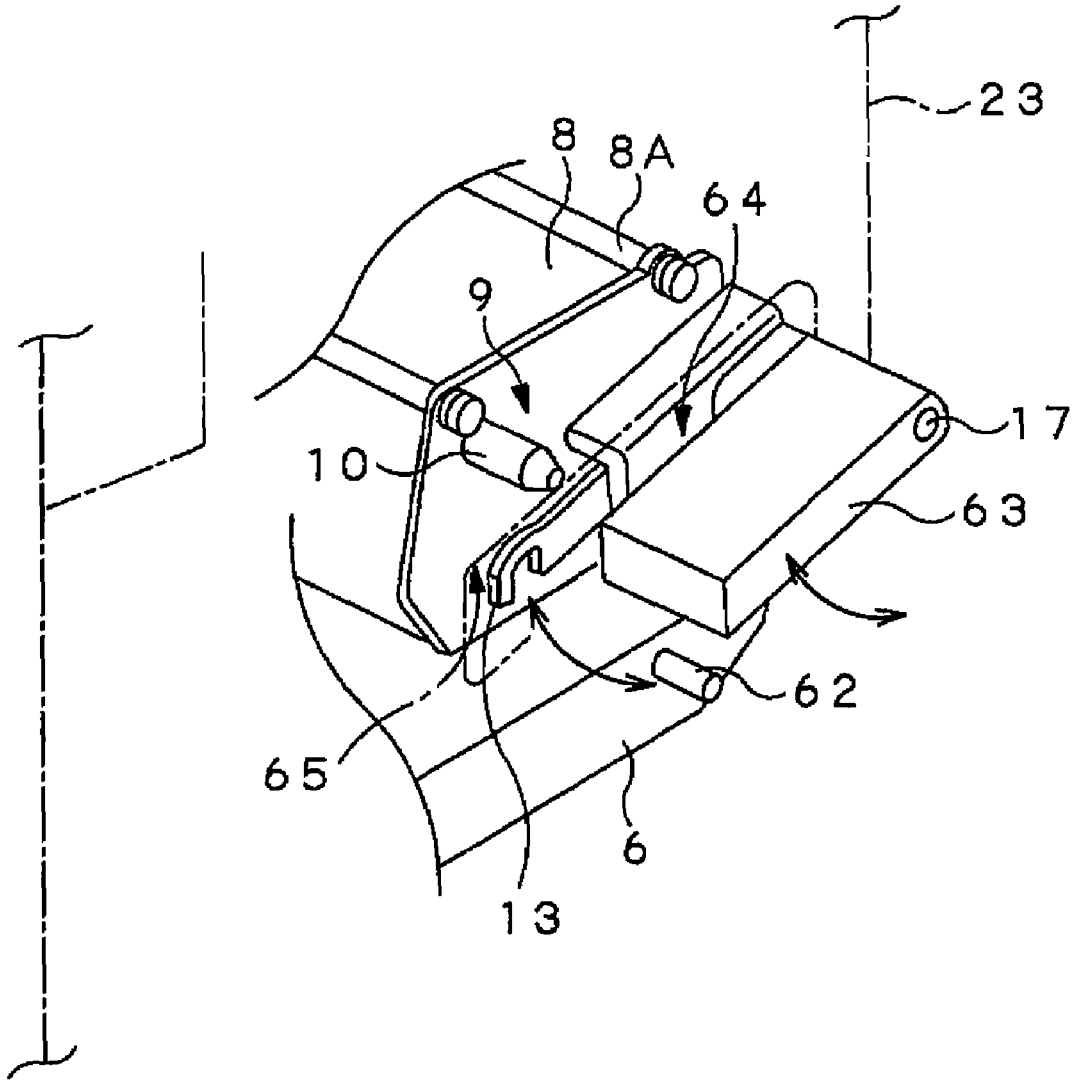
FIG. 11 is a main part expanded view of a head opening/shutting lever component.

FIG. 11 is a main part expanded perspective view of the head opening/shutting lever 13 component, the head opening/shutting lever 13 being attachable with a lever fixing pin 62 protrudingly fixed in the base frame 6 so that the thermal head 11 is able to be pressed at a predetermined pressure on the platen roller 12.

The cassette attachment lever 63 is concentrically provided about the lever shaft 17 of the head opening/shutting lever 13, the cassette attachment lever 63 and head opening/shutting lever 13 being connected to be integrally operable.

Accordingly, a head lock (approach/separate operation) between the thermal head 11 and platen roller 12 and a cassette lock (mounting operation) of the cassette main body 21 in the printer main body 2 can be jointly implemented by operation of this single cassette attachment lever 63. This facilitates improvement to the assembly workability and a reduction in the number of assembly steps.

Furthermore, the base plate interval 64 slightly larger than the thickness of the printer-side base plate 22 of the cassette main body 21 is provided between the head opening/shutting lever 13 and the cassette attachment lever 63.

Accordingly, as a result of the base plate interval 64 section being positioned in the printer-side base plate 22 subsequent to the cassette attachment lever 63 being operated in the lock direction (anti-clockwise direction in FIG. 11) after the cassette main body 21 has been pushed in the printer main body 2 direction until the printer main body opposing face 32 of the cassette main body 21 has abutted the cassette attachment face 5 of the printer main body 2, that is to say, as a result of the head opening/shutting lever 13 and cassette attachment lever 63 being positioned on the upper and lower faces of the printer-side base plate 22, the ribbon cassette apparatus 3 (cassette main body 21) as a whole is fixable to the printer main body 2 side and fallout of the cassette main body 21 from the printer main body 2 side is prevented.

Moreover, a guide cut-away part 30 (FIG. 5) is formed in the printer-side base plate 22 and, when the ribbon cassette apparatus 3 as a whole is moved toward the handle-side base plate 23 in the printer main body 2 direction, a lever window part 65 through which the head opening/shutting lever 13 and the cassette attachment lever 63 are able to pass (FIG. 5) in the opened state of the thermal head 11 with respect to the platen roller 12 is formed whereupon, in the opened state of the thermal head 11 described above, a mounting operation of the cassette main body 21 in which it is moved until abutting the printer main body 2 without colliding with the head opening/shutting lever 13 and the cassette attachment lever 63 is possible.

Figure 12:
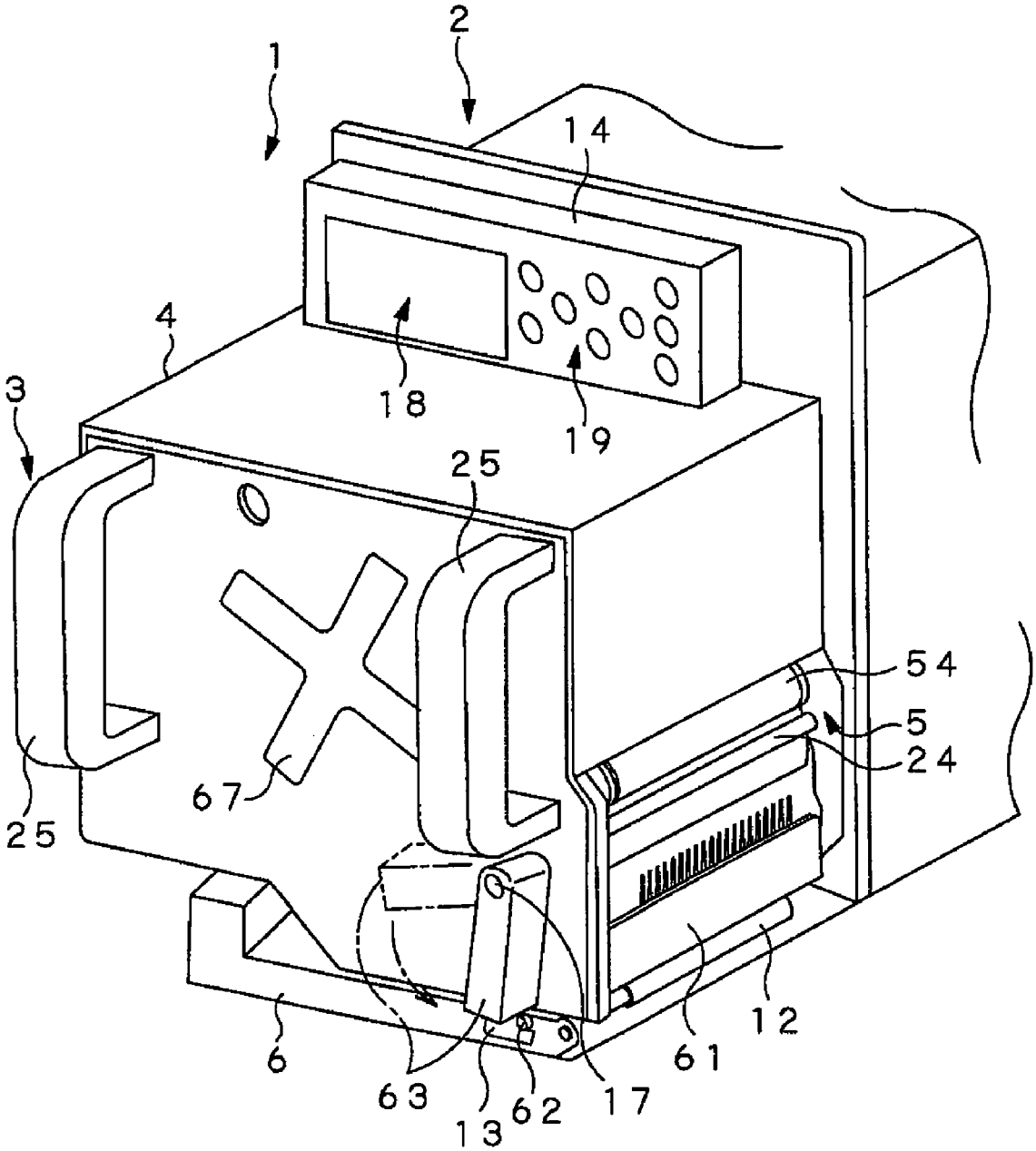
FIG. 12 is a perspective view showing a state in which a cassette attachment lever is operated after the cassette main body (ribbon cassette apparatus) has been inserted into the printer main body.

FIG. 12 is a perspective view showing a state in which the cassette attachment lever 63 is operated after the cassette main body 21 (ribbon cassette apparatus 3) has been inserted in the printer main body 2, the head opening/shutting lever 13 integral with the cassette attachment lever 63 being engaged with the lever fixing pin 62 to complete the mounted state of the ribbon cassette apparatus 3 in the printer main body 2 as a result of the turning operation of the cassette attachment lever 63 from the virtual line to the state shown by the solid line in the diagram.

As shown in FIG. 1 in particular, the cover 4 mounted on the cassette attachment face 5 of the printer main body 2 fulfils a dust-prevention and waterproofing function, and an insert opening hole 66 is formed in the cassette main body 21 to facilitate guiding of the cassette main body 21 to the printer main body 2 side.

When the cassette main body 21 is directed toward the printer main body 2 side and is subsequently moved toward the printer main body 2, the guide direction and position of the cassette main body 21 is clearly indicatable to an operator performing the mounting through the cover 4 itself and, in reality, a guiding of the left and right edge parts and upper edge part of the printer-side base plate 22 and handle-side base plate 23 of the cassette main body 21 is performed.

Moreover, a transparent window 67 that facilitates confirmation from the exterior with the naked eye of the thermal transfer ribbon R in the interior of the cover 4 is formed in the approximate center part of the handle-side base plate 23. Naturally, an equivalent transparent window can also be formed in the upper part of the cover 4.

In a thermal transfer printer 1, printer main body 2 and ribbon cassette apparatus 3 of this configuration, the mounting of the ribbon cassette apparatus 3 in the printer main body 2 is based on the handles 25 being held and the cassette main body 21 being operated in the printer main body 2 direction.

First, the main guide hole 29 of the cassette main body stay 28 is engaged with the cassette main body 21 of the main guide shaft 7 of the printer main body 2 and, furthermore, the guide cut-away part 30 of the printer-side base plate 22 is moved along the upper surface of the printer main body stay 8 and the arc-shaped end part 8A thereof as the cassette main body 21 is moved toward the cassette attachment face 5 of the printer main body 2.

Next, the cassette main body 21 is able to be attached to the printer main body 2 as a result of the engagement of the assist engagement pins 33 of the printer-side base plate 22 with the assist engagement holes 34 in the cassette attachment face 5 of the printer main body 2 and, in addition, the engagement of the guide pin 59 in the cassette attachment face 5 with the through-hole 60 in the printer-side base plate 22 and, furthermore, the engagement of the final positioning engagement pin 10 of the printer main body stay 8 with the final positioning engagement hole 31 of the handle-side base plate 23, the cassette main body 21 being opposed to the printer main body 2 with a predetermined position accuracy with adsorption between the magnet 35 and the iron piece 36.

In this attached state, the follower gears (supply spindle follower gear 26B, winding spindle follower gear 27B) of the ribbon supply spindle 26 and winding supply spindle 27 are engaged with the drive gears (supply spindle driver gear 43, winding spindle driver gear 44) of the printer main body 2, and the detection gears thereof (supply spindle detection gear 26C, winding spindle detection gear 27C) are engaged with the sensor gears (supply spindle sensor-side gear 45, winding spindle sensor-side gear 46 ) of the printer main body 2.

Simultaneously with this engagement, follower gears (upstream-side follower gear 53A, downstream-side follower gear 54A) of the upstream-side assist roller 53 and downstream-side assist roller 54 are engaged with the driver gears (upstream-side driver gear 55, downstream-side driver gear 56) of the printer main body 2.

Finally, as shown in FIG. 12, in an operation using the cassette attachment lever 63 to effect completion of the mounting operation, a head lock between the thermal head 11 and platen roller 12 (approach/separate operation) and a cassette lock of the cassette main body 21 on the printer main body 2 (mounting operation) is performed.

Removal of the cassette main body 21 from the printer main body 2 involves, upon release of the cassette lock and head lock by a turning operation of the cassette attachment lever 63 in the clockwise direction of FIG. 12, the handles 25 being held and the cassette main body 21 as a whole being pulled out from the printer main body 2 whereupon, conversely to that described above, the adsorption and engagements between the cassette main body 21 and printer main body 2 are released to allow the cassette main body 21 to be removed.

By the attachment of the main guide hole 29 of the cassette main body stay 28 and the main guide shaft 7 of the printer main body 2 and the attachment of the final positioning engagement hole 31 of the handle-side base plate 23 with the final positioning engagement pin 10 of the printer main body stay 8 in this way in particular, the cassette main body 21 can be attached to the printer main body 2 with a predetermined relative positional accuracy.

Furthermore, the ribbon supply spindle 26 and winding supply spindle 27 can be set in advance in the cassette main body 21, and the operation for the replacement of the thermal transfer ribbon R can be implemented easily.

In addition, because the mounting operation itself of the cassette main body 21 is a simple operation requiring simply a pushing thereof while the handles 25 are being held, the cassette main body 21 can be easily mounted without effect on the position and positional arrangement of the printer main body 2.

Naturally, because it involves holding of a left-right pair of handles 25, the mounting operation in which the cassette main body 21 is moved toward the printer main body 2 side can be stably performed.

Various alterations and supplementary configurations can be made to the present invention in accordance with need.

Figure 13:
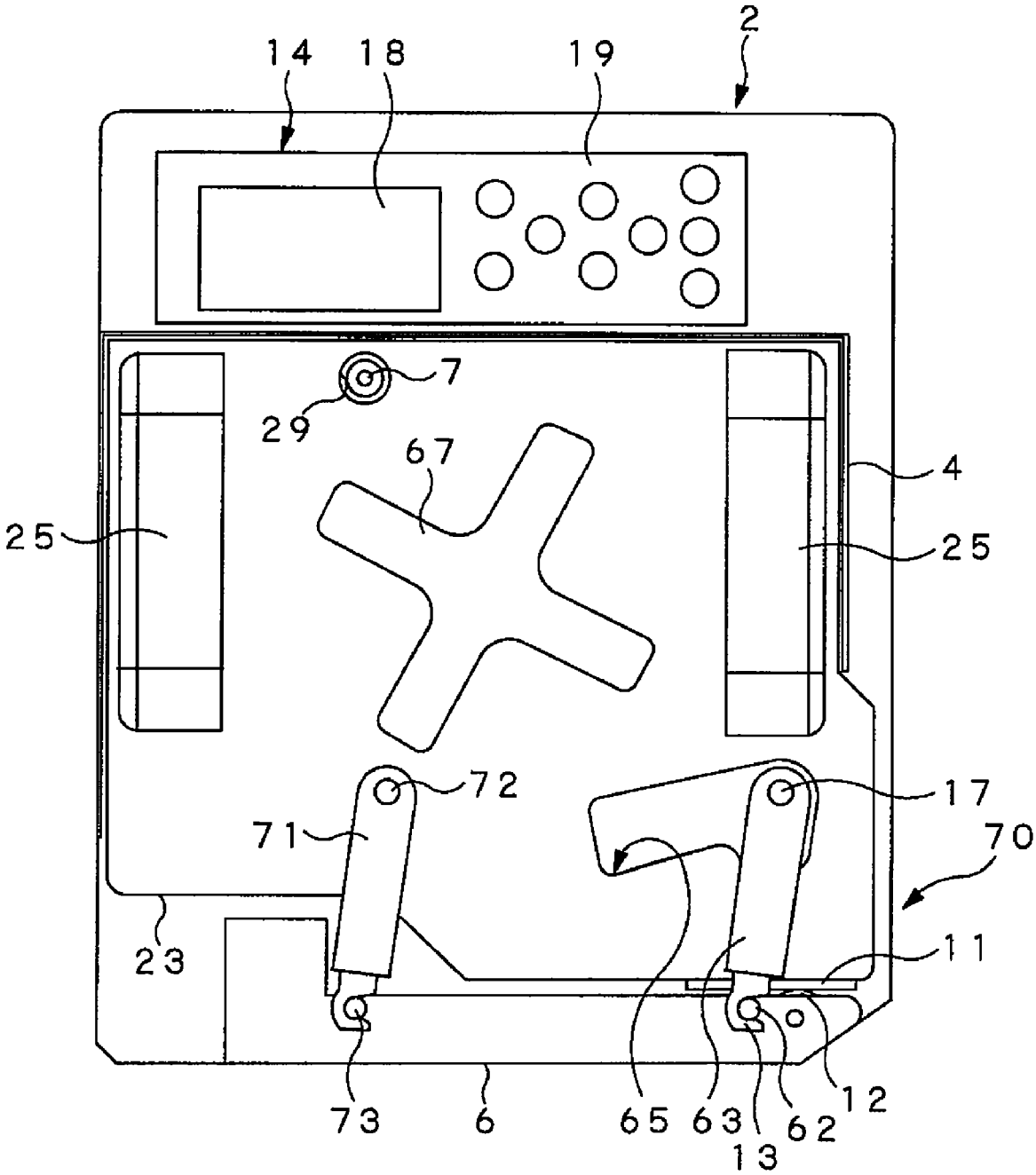
FIG. 13 is a front view of a ribbon cassette apparatus of a second embodiment of the present invention.

For example, FIG. 13 is a front view of a ribbon cassette apparatus 70 based on a second embodiment of the present invention in which, in addition to the previously described configuration, that is to say, a configuration in which the lever fixing pin 62 is provided in the base frame 6 of a printer main body 2 and the head opening/shutting lever 13 is attachably provided in the lever fixing pin 62 so that the thermal head 11 is able to be maintained in a pressed state at a predetermined pressure in the platen roller 12, in the ribbon cassette apparatus 70 the base frame 6 and cassette main body 21 may be firmly fixed to each other.

More specifically, the handle-side base plate 23 is able to be fixed to the base frame 6 by the provision of an assist opening/shutting lever 71 in the handle-side base plate 23 in the upstream-side of the transport path 16 from the platen roller 12 part that is tumably operable around an assist lever shaft 72, and the provision of an assist lever pin 73 in the base frame 6 and engagement of the assist lever pin 73 and the assist opening/shutting lever 71.

According to this configuration, as a result of the integration of base frame 6 with the cassette main body 21 afforded by the engagement of the head opening/shutting lever 13 and the cassette attachment lever 63 with the lever fixing pin 62 in the region of the platen roller 12 and the integration with the cassette main body 21 afforded by the engagement of the assist opening/shutting lever 71 with the assist lever pin 73 of the upstream-side of the platen roller 12, the handle-side base plate 23 (ribbon cassette apparatus 70) and base frame 6 are reliably supported in two places.

Accordingly, the vibration of the base frame 6 component accompanying printing on the thermal transfer ribbon R and the transport thereof and, furthermore, the possibility of the vibration increasing in the thermal transfer printer 1 as a whole accompanying an increase in the size of the thermal transfer ribbon R and the cassette main body 21 can be suppressed, and undesirable effects to the printing on the thermal transfer ribbon R and the transport thereof in the thermal transfer printer 1 can be avoided.

Figure 14:
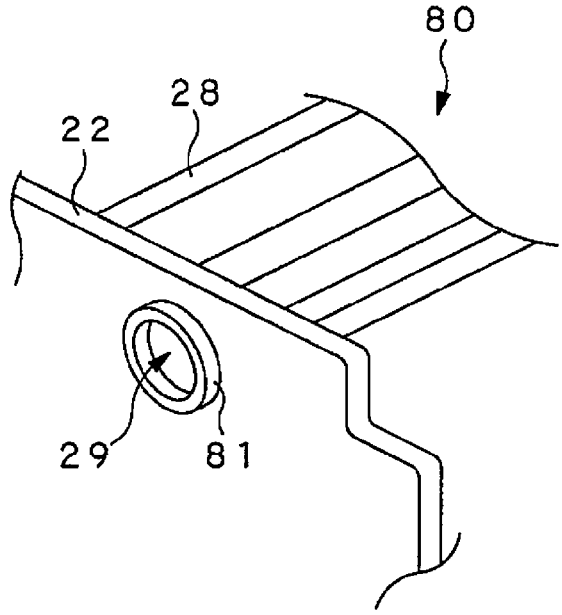
FIG. 14 is a main part expanded perspective view of a cassette main body stay as seen from the printer main body side in an ribbon cassette apparatus of a third embodiment of the present invention.

FIG. 14 is a main part expanded view of the cassette main body stay 28 as seen from the printer main body 2 side in a ribbon cassette apparatus 80 based on a third embodiment of the present invention in which, in the ribbon cassette apparatus 80, a rubber cushion member or other elastic member 81 is mounted to abut the opening edge part in particular of the main guide hole 29 of the cassette main body stay 28 in the printer-side base plate 22 of the cassette main body 21 thereof facing the cassette attachment face 5 of the printer main body 2.

Figure 15:
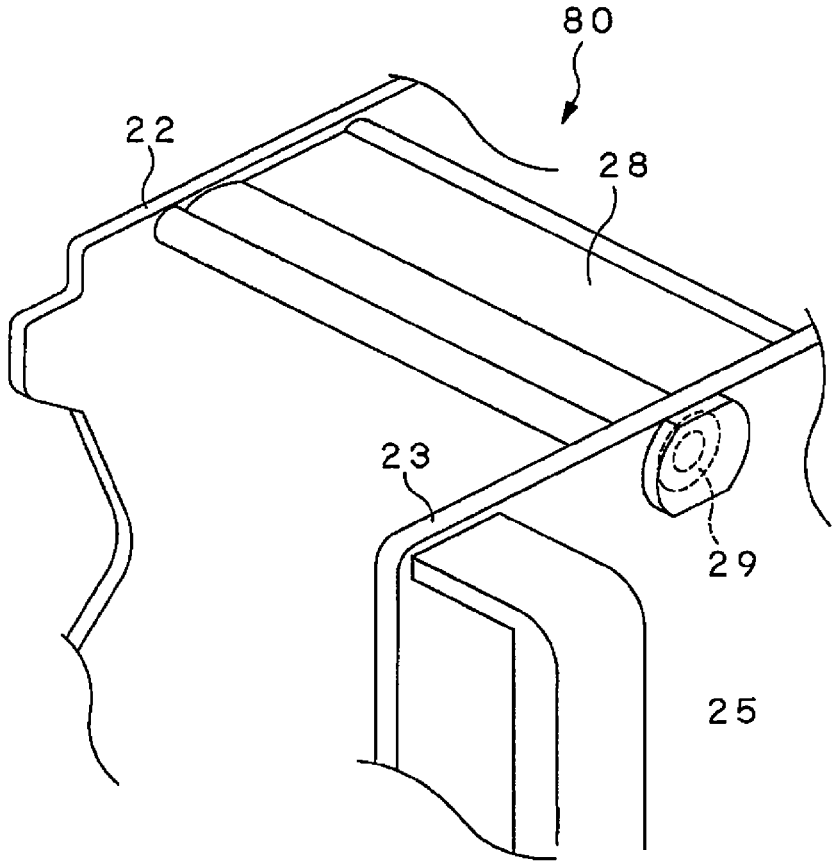
FIG. 15 is a main part expanded perspective view of a cassette main body stay as seen from the direction of the printer main body.

FIG. 15 is a main part expanded perspective view of the cassette main body stay 28 component as seen in the printer main body 2 direction, an end part of the main guide hole 29 of the cassette main body stay 28 of the opposing side to the printer main body 2 being closed.

In the ribbon cassette apparatus 80 of this configuration the impact noise generated when the cassette main body 21 is attached to the printer main body 2 can be suppressed, the wear of the cassette main body 21 (printer-side base plate 22) can be suppressed, and the durability thereof can be improved by the elastic member 81. Furthermore, because the main guide hole 29 is opened only in the printer-side base plate 22 the residual air within the main guide hole 29 performs an air-damper action accompanying the engagement of the main guide hole 29 and main guide shaft 7 and, accordingly, even if the operation for mounting the ribbon cassette apparatus 80 in the printer main body 2 is performed quickly, the speed of insertion thereof is slowed as it is inserted and, in the end, a gentle insertion action that allows the mounting operation to be completed with reduced impact is facilitated.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A thermal transfer printer ribbon cassette apparatus releasably attached to a thermal transfer printer which comprises:

the printer comprises a printer main body, a thermal head and a platen roller mounted to the main body and being operable such that a printing sheet and a thermal transfer ribbon are held between the thermal head and the platen roller and are transported, and the thermal head and the platen roller perform printing on the printing sheet, the printer main body having a printer has a cassette attachment face, the cassette apparatus comprises a cassette main body formed by a printer-side base plate that extends along a direction of transport of the printing sheet and the thermal transfer ribbon and that opposes the cassette attachment face of the printer main body, a handle-side base plate that opposes the printer-side base plate and that comprises handles for an attachment/detachment operation, and a support shaft for fixing the handle-side base plate and the printer-side base plate with a gap not less than the width of the thermal transfer ribbon and the printing sheet, the cassette main body comprises a ribbon supply spindle for supplying the thermal transfer ribbon to a transport path for the thermal transfer ribbon and a ribbon winding spindle for winding the thermal transfer ribbon transported on the transport path, the spindles are releasably disposed between the handle-side base plate and the printer-side base plate, a cassette main body stay positioned between the handle-side base plate and the printing-side base plate, the stay having a main guide hole into which a main guide shaft protruding from the printer main body side in the cassette main body direction is fit removably, a guide cut-away part guidable along the printer main body stay formed from the printer main body side toward the printer-side base plate and being formed in the printer-side base plate, a final positioning engagement pin being formed in the printer main body stay of the printer main body, and a final positioning engagement hole being formed in the handle-side base plate, the cassette main body being releasably attached to in the printer main body by engagement and disengagement of the main guide shaft of the printer main body with and from the main guide hole of the cassette main body stay and by engagement and disengagement of the final positioning engagement pin of the printer main body stay with and from the final positioning engagement hole of the handle-side base plate.

2. The thermal transfer printer ribbon cassette apparatus as claimed in claim 1, further comprising a cover mounted in the printer main body, an opening formed in the cassette main body side through which the cassette main body is guidable to the printer main body side.

3. The thermal transfer printer ribbon cassette apparatus as claimed in claim 1, wherein the printer-side base plate comprises an auxiliary engagement pin provided toward the printer main body side, and an auxiliary engagement hole into which the auxiliary engagement pin is engageable formed in the cassette attachment face of the printer main body.

4. The thermal transfer printer ribbon cassette apparatus as claimed in claim 1, further comprising a head opening and closing lever operable for a contact and separation of the thermal head and the platen roller, and a cassette attachment lever operable for fixing the cassette main body to the printer main body whereby the bodies are connected to be integrally operable.

5. The thermal transfer printer ribbon cassette apparatus as claimed in claim 1, further comprising a supply spindle guide groove and a winding spindle guide groove along which the ribbon supply spindle and the ribbon winding spindle respectively are guidable in set directions thereof, the grooves being formed in an inner-side wall face of the handle-side base plate and the printer-side base plate respectively, a spindle receiving member operable to fix the ribbon supply spindle and the ribbon winding spindle to respective set positions thereof and the receiving member being located in a rearmost part of the supply spindle guide groove and the winding spindle guide groove.

6. The thermal transfer printer ribbon cassette apparatus as claimed in claim 1, further comprising driven gears formed in the printer main body side end parts of each of the ribbon supply spindle, driver gears that face the cassette attachment face of the printer main body, and the ribbon winding spindle and the driven gears are engageable with the driver gears;

gear end parts of each of the driven gears and driver gears being formed in a tapered shape.

7. The thermal transfer printer ribbon cassette apparatus as claimed in claim 1, further comprising a magnet in at least one of the cassette attachment face of the printer main body and a printer main body opposing face opposing the printer main body of the printer-side base plate, and the cassette main body is attachable to the printer main body.

8. The thermal transfer printer ribbon cassette apparatus as claimed in claim 1, further comprising an elastic member mounted in an opening edge part of the main guide hole of the cassette main body, and the opening edge part is toward the cassette attachment face of the printer main body.

9. The thermal transfer printer ribbon cassette apparatus as claimed in claim 1, wherein an end part of the cassette main body stay located on the opposing side to the printer main body of the main guide hole is opened.

10. The thermal transfer printer ribbon cassette apparatus as claimed in claim 1, wherein an end part of the cassette main body stay located on the opposing side to the printer main body of the main guide hole is closed.

11. The thermal transfer printer ribbon cassette apparatus as claimed in claim 1, further comprising a lever fixing pin in the vicinity of the platen roller and located in a base frame of the printer main body, and a head opening and closing lever engaged with or disengaged from the lever fixing pin so that when the lever is engaged the thermal head is able to be held in a pressed state at a predetermined pressure on the platen roller, the handle-side base plate being operable to be fixed to the base frame by an auxiliary opening and closing lever in the handle-side base plate in a different position from a position of the head opening and closing lever and an auxiliary lever fixing pin in the base frame and by engagement of the auxiliary lever fixing pin and the auxiliary opening-closing lever.

12. A thermal transfer printer ribbon cassette mounting method for setting the thermal transfer printer ribbon to a thermal transfer printer, wherein the printer comprises a printer main body wherein a thermal head and a platen roller are mounted and wherein a printing sheet and a thermal transfer ribbon are held between the thermal head and the platen roller and are transported, and which performs printing on the printing sheet, the method comprising:

forming a cassette main body by providing a printer-side base plate that extends along a direction of transport of the printing sheet and the thermal transfer ribbon and that opposes a cassette attachment face of the printer main body, a handle-side base plate that opposes the printer-side base plate and that comprises handles for an attachment/detachment operation, and a support shaft for fixing the handle-side base plate and the printer-side base plate with a gap not less than the width of the thermal transfer ribbon and the printing sheet;

forming the cassette main body to comprise a ribbon supply spindle for supplying the thermal transfer ribbon to a transport path for the thermal transfer ribbon and a ribbon winding spindle for winding the thermal transfer ribbon transported to this transport path that are able to be releasably disposed between the handle-side base plate and the printer-side base plate, and a cassette main body stay positioned between the handle-side base plate and the printing-side base plate and a main guide hole formed in the cassette main body stay into which a main guide shaft protruding from the printer main body side in the cassette main body direction is fit removably;

forming a guide cut-away part guidable along the printer main body stay formed from the printer main body side toward the printer-side base plate in the printer-side base plate;

forming a final positioning engagement pin in the printer main body stay of the printer main body, and a final positioning engagement hole in the handle-side base plate;

operating the cassette main body by way of handles to engage the main guide shaft hole of the cassette main body stay with the main guide shaft of the printer main body, moving the guide cut-away part of the printer-side base plate along the printer main body stay as the cassette main body is moved nearer the cassette attachment face of the printer main body; and engaging the final positioning engagement hole of the handle-side base plate with the final positioning engagement pin of the printer main body stay so that the cassette main body can be attached to or detached from the printer main body.

* * * * *